US006116444A

United States Patent [19]

Bösl et al.

[11] Patent Number: 6,116,444

[45] Date of Patent: Sep. 12, 2000

[54] PLASTIC CLOSURE CAP

[75] Inventors: Udo Bösl, Eimeldingen; Michael Kirchgessner, Egringen, both of Germany

[73] Assignee: Crown Cork AG, Reinach, Switzerland

[21] Appl. No.: 08/981,047

[22] PCT Filed: Jun. 4, 1996

[86] PCT No.: PCT/CH96/00211

§ 371 Date: Feb. 23, 1998

§ 102(e) Date: Feb. 23, 1998

[87] PCT Pub. No.: WO97/00210

PCT Pub. Date: Jan. 3, 1997

[30] Foreign Application Priority Data

Jun. 15, 1995 [CH] Switzerland ..... 1769/95

[51] Int. Cl.[7] ..... B65D 39/00

[52] U.S. Cl. ..... 215/253; 215/275; 215/305

[58] Field of Search ..... 215/253, 295, 215/305

[56] References Cited

U.S. PATENT DOCUMENTS

| | | | |
|---|---|---|---|
| 3,462,035 | 8/1969 | Grussen . | |
| 3,589,543 | 6/1971 | Weigand | 215/253 X |
| 3,858,742 | 1/1975 | Grussen | 215/253 |
| 3,866,784 | 2/1975 | Beck . | |
| 3,899,097 | 8/1975 | Aichinger . | |
| 4,230,229 | 10/1980 | Crisci . | |
| 4,534,481 | 8/1985 | Summers et al. . | |

FOREIGN PATENT DOCUMENTS

| | | |
|---|---|---|
| 1 604 276 | 10/1971 | France . |
| 1 782 059 | 1/1972 | Germany . |
| 529 022 | 11/1972 | Switzerland . |
| 553 696 | 9/1974 | Switzerland . |
| 2 097 768A | 11/1982 | United Kingdom . |
| WO 93/21080 | 10/1993 | WIPO . |

*Primary Examiner*—Stephen K. Cronin
*Attorney, Agent, or Firm*—Woodcock Washburn Kurtz Mackiewicz & Norris LLP

[57] ABSTRACT

A closure cap for closure of containers possesses a closure base (2), a wall (3), and a pull-off ring (7). The pull-of ring is connected to the wall (3) at connecting points (8). In order to open the closure cap, a force is exerted onto the pull-off ring (7), by which means two vertical frangible lines (9) lying adjacent to the connecting points (8) will be destroyed. As a result, an area of the wall (3) can be bent outwards and opening of the closure cap will be facilitated.

10 Claims, 4 Drawing Sheets

PLASTIC CLOSURE CAP

BACKGROUND OF THE INVENTION

1. Field of the Invention

The invention concerns a plastic closure cap according to the preamble to claim 1. These types of closure caps are mainly used for the closure of containers, and in particular of bottles with liquid contents.

2. Description of Related Art

If the closure cap is used on containers with beverages containing carbon dioxide, the closure cap must under certain conditions also remain reliably in contact with the container mouth under considerable gas pressure. For this reason, retaining means are anticipated on the countainer mouth and on the inner side of the closure cap by which means the closure cap can engage with the container mouth. As a result, however, intentional manual removal of the closure cap will also be hindered. In order to solve this problem, various suggestions are known.

For example, CH-PS-529 022 shows a plastic closure cap provided with a strap engaging around the outer wall, by which means the closure cap can be withdrawn from the container mouth under the exertion of force.

CH-PS-553 696 shows a closure cap which, on its casing, is provided with a press lug and frangible points. The closure cap can be removed by means of depressing the press lug. Through the extertion of pressure on the press lug, the frangible points will sever, permitting the retention element to be overcome more easily. Apart from that, severed frangible points will reveal unauthorized opening of the container.

DE-DO-1 782 059 shows a plastic closure cap which is provided with a pull-off ring and integrated zones of weakness on the cap casing. If, in order to open the closure, a force is applied to the pull-off ring, the said zones of weakness will break, by which means opening of the closure cap will be facilitated. The closure cap retaining elements possess additional sections of less thickness and if necessary also perforations, in order to impart increased flexibility to the cap.

However, all these closure caps suffer various disadvantages: either considerable force will still be required in order to open the cap, or the closure is so elastic that it can easily be ejected from the container mouth by the internal pressure. On the one hand, with solutions that recommend press elements or press lugs, the disadvantage is that only a relatively short lever arm can be created; on the other hand, the zones of weakness on the lower skirt edge are restricted, so that breaking of these zones of weakness will not facilitate opening to any degree.

The object of the invention is thus to avoid the disadvantages of the state of the art, and therefore in particular to create a plastic closure cap for beverages containing $C0_2$ which can be removed from the container mouth with the least possible application of force. In addition, the closure cap shall also display initial opening of the container.

BRIEF SUMMARY OF THE INVENTION

According to the invention, this object is primarily fulfilled according to the characterizing section of claim 1.

The closure cap possesses a cap base and a cylindrical wall connected to said base. A retaining bead is provided on the inside of the cylindrical wall, said retaining bead being able to be brought into engagement with the retaining elements in the area of the container mouth. In order to open the closure cap, a pull-off ring is provided, said ring being connected to the edge area of the wall at at least one, preferably however two connecting points, said edge area being able to be placed upon the container opening. The pull-off ring runs concentrically to and surrounds the wall, and can be continuous or also open ended. In order to facilitate the opening procedure of the closure cap, the wall is provided with frangible lines. These frangible lines run vertically from the edge area of the wall upwards towards the closure base, and are arranged adjacently to the connecting points between the pull-off ring and the wall.

In order to open the closure cap, the pull-off ring is bent upwards and, with a pull of the finger, a force is exerted onto the connecting points between the pull-off ring and the wall. Through the proximity to the frangible lines, and by means of the connection in the edge area of the wall, the pull-off ring is connected in an optimal way to the wall. As a result, the force applied to the closure cap in order to open it can be exploited to the maximum. The opening force is directly applied to the frangible lines by the pull-off ring, by which means said frangible lines can tear open easily. The closure can then be removed with a slight application of force.

An additional reduction of the applied force required to open is attained in that the frangible lines are led approximately vertically from the edge area of the wall to beyond the innermost point of the retaining bead. When the frangible lines tear open, as a result a portion of the retaining bead will break away, and will no longer be in engagement with the container mouth retaining elements. Additionally, torn frangible lines will display prior opening of the closure cap, and will thus have the anti-tamper function of assuring originality.

In a particularly preferred embodiment, the pull-off ring is connected to the wall at two connecting points. By means of such a construction, the force imparted onto the closure cap by the pull-off ring will take effect exactly on the frangible lines, said frangible lines being arranged adjacent to both these connecting points.

In a further preferred embodiment, the pull-off ring, notwithstanding the fixed connecting points, is additionally connected with one or more frangible bridges to the edge area of the wall. As a result, the pull-off ring will be held in position. For example, during transport, interlocking and fouling of the pull-off ring and inadvertent opening of the closure will be avoided. On the other hand, such frangible bridges will also serve as assurance of originality. In order to open the closure cap, the pull-off ring must be separated from the wall and pulled upwards.

The pull-off ring can be formed as an open-ended ring, extending as an annular sector from one connecting point to another around the wall. As a result of the pull-off ring terminating in the area of the connecting points, an optimal transfer of the force from the pull-off ring onto the wall will be attained. However, a ring formed to be continuous will also be advantageous, said ring being connected to the wall by one or more connecting points. Also, with such a continuous pull-off ring, mainly the risk of interlocking and fouling of the closure caps of a plurality of containers will also be reduced.

Preferably, the retaining bead running around the inside of the wall possesses one or more vertical interruptions. The retaining bead is thus divided into a plurality of sections, and this imparts an additional flexibility to the closure cap. This is primarily advantageous during the opening procedure. Preferably, two of the said interruptions are arranged in such a way that the vertical frangible lines cross the retaining bead in the area of the interruptions. If, on opening of the closure, the wall is torn open in the area lying between the frangible lines, a segment of the wall will be folded upwards, said segment carrying a section of the retaining bead. This section is thus no longer in engagement with the retaining elements of the container, by which means there will be a clear reduction in the force required to open the closure.

The vertical frangible lines can be applied to both the inside and the outside of the wall. With that, the frangible lines are preferably designed as weaknesses in the wall material.

In a further embodiment, a horizontal hinge is arranged in the wall above the frangible lines, said hinge running between the frangible lines arranged adjacent to the connecting point or points. As a result, folding up of the wall area between frangible lines will be facilitated, said area preferably containing a section of the retaining bead. The hinge can take the form of a weakening of the material. With that, the wall must be formed to be thicker in the area of the hinge than in the area of the frangible lines so that, on opening, the entire wall segment is not torn out of the wall.

A closure cap with optimal properties will result if the aforesaid embodiments are also provided with sealing elements in the area of the closure cap base and/or the wall. As sealing elements, sealing lips running concentrically to the wall are suitable, said sealing lips resting against the inner or outer surface of the container mouth.

The invention is more closely described using the following embodiments and with the aid of the drawings: namely,

DETAILED DESCRIPTION OF THE INVENTION

Figure 1:
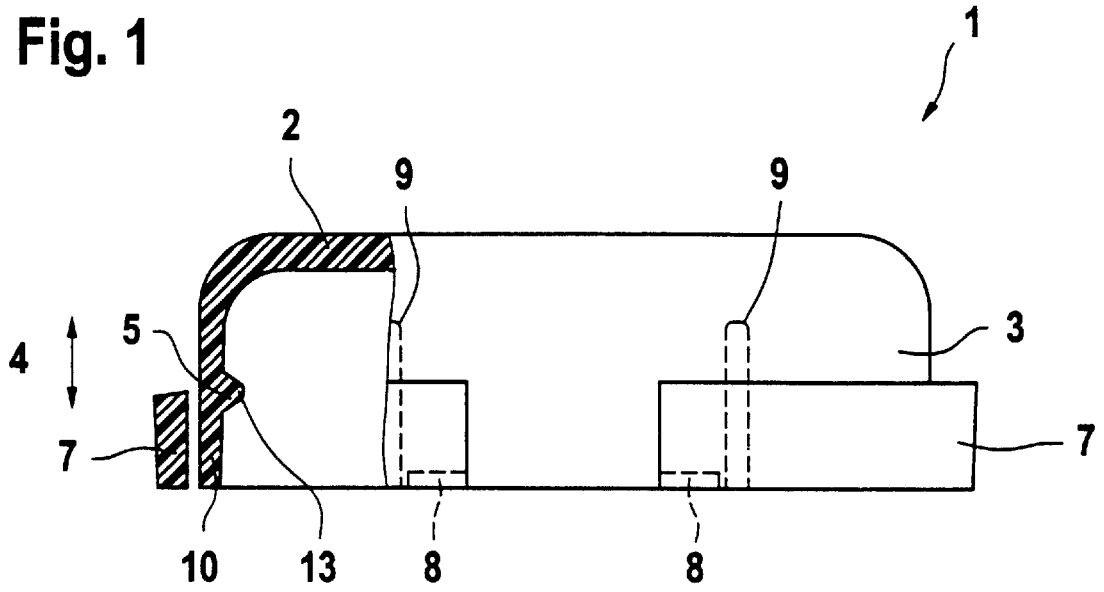
FIG. 1 a side view of a closure cap according to the invention, with a partial cross section, FIG. 2 a view of the wall section seen at an enlarged scale from within the closure cap, FIG. 3 a closure cap from below, FIG. 4 a schematic representation of a closure cap during the opening procedure, FIGS. 5 to 7 views from below of related embodiments of the invention, and FIGS. 8 and 9 a cross section of a closure cap section in the area of the connecting points.

According to FIG. 1, a closure cap possesses a circular disc-shaped closure base 2 and a cylindrical wall 3 abutting the edge of said closure base 2. In an attachment area 4, the wall 3 is provided with a means of attaching the closure cap 1 to a container mouth. A retaining bead 5 serves as an attachment means, said retaining bead being annular and pointing radially inwards, and running around the inside of the wall 3. On its surface lying at the radially innermost point, the retaining bead 5 possesses a retaining area 13, said retaining area engaging with the retaining elements of the container mouth.

A pull-off ring 7 is connected at two connecting points 8 to the edge area 10 of the wall 3, said edge area oriented away from the closure base 2. The pull-off ring 7 is not completely continuous, and runs around the wall concentrically to said wall, and thus extends around an annular sector of preferably at least 270°. This means that both the connecting points 8 are arranged on the wall adjacent to one another. Apart from that, frangible lines 9 are provided in the wall 3, said frangible lines extending from the edge section 10 of the wall 3 approximately vertically towards the closure base 2 and beyond the retaining area 13 of the retaining bead 5. The frangible lines 9 are arranged adjacently to the connecting points 8 so that the force imparted by the pull-off ring 7 on opening the closure cap 1 is transferred onto the wall 3 in the area of the frangible lines 9 in an optimal way. In order to open the closure cap 1, the pull-off ring 7 is pulled upwards and rotated about the connecting points 8 in such a way that the wall 3 is no longer surrounded by the pull-off ring 7. By exerting a pulling force onto the pull-off ring 7, both frangible lines 9 will be destroyed and an area of the wall 3 will be released. The closure cap 1 is now no longer engaged with the entire retaining bead 5 with the retaining elements in the area of the container mouth, and can thus easily be removed.

Figure 2:
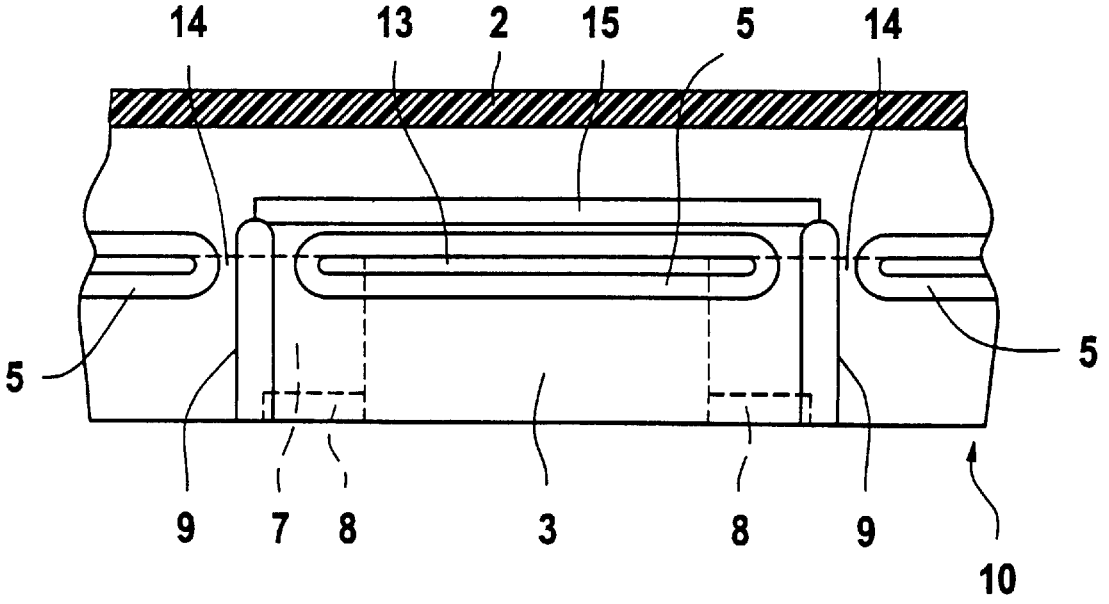

In FIG. 2, it can be seen how the wall 3 of the closure cap 1 of a particular embodiment is constructed in the area of both connecting points. The pull-off ring 7 and both the connecting points 8 lie on the outside of the wall and are suggested in FIG. 2. Both the connecting points 8 lie in the area between the outer defining lines of both frangible lines 9. In order to optimise the transfer of force from the pull-off ring 7 to the frangible lines 9, the connecting points 8 can extend over the inner defining lines of the frangible lines 9 into the area of the frangible lines 9. Although only shown in FIG. 2, such an arrangement is advantageous for all other embodiments.

The retaining bead 5 is divided up by interruptions 14 in this embodiment, by which means individual sections of the retaining bead 5 will result. One section lies in the area of the wall that is defined by both the frangible lines 9. Both the frangible lines 9 commence in the edge area 10 of the wall 3 and extend vertically upwards and beyond the retaining area 13 of the retaining bead 5. In order to increase the flexibility of the area formed by both the vertical frangible lines, a hinge 15 running horizontally is provided in the wall 3 at the end of the frangible lines 9. The hinge 15 is formed as a slight weakening of the material in the wall 3. On opening the closure, the area defined by both the vertical frangible lines 9 is broken away from the wall 3 and can be easily folded around the hinge 15, as shown in FIG. 4.

Figure 3:
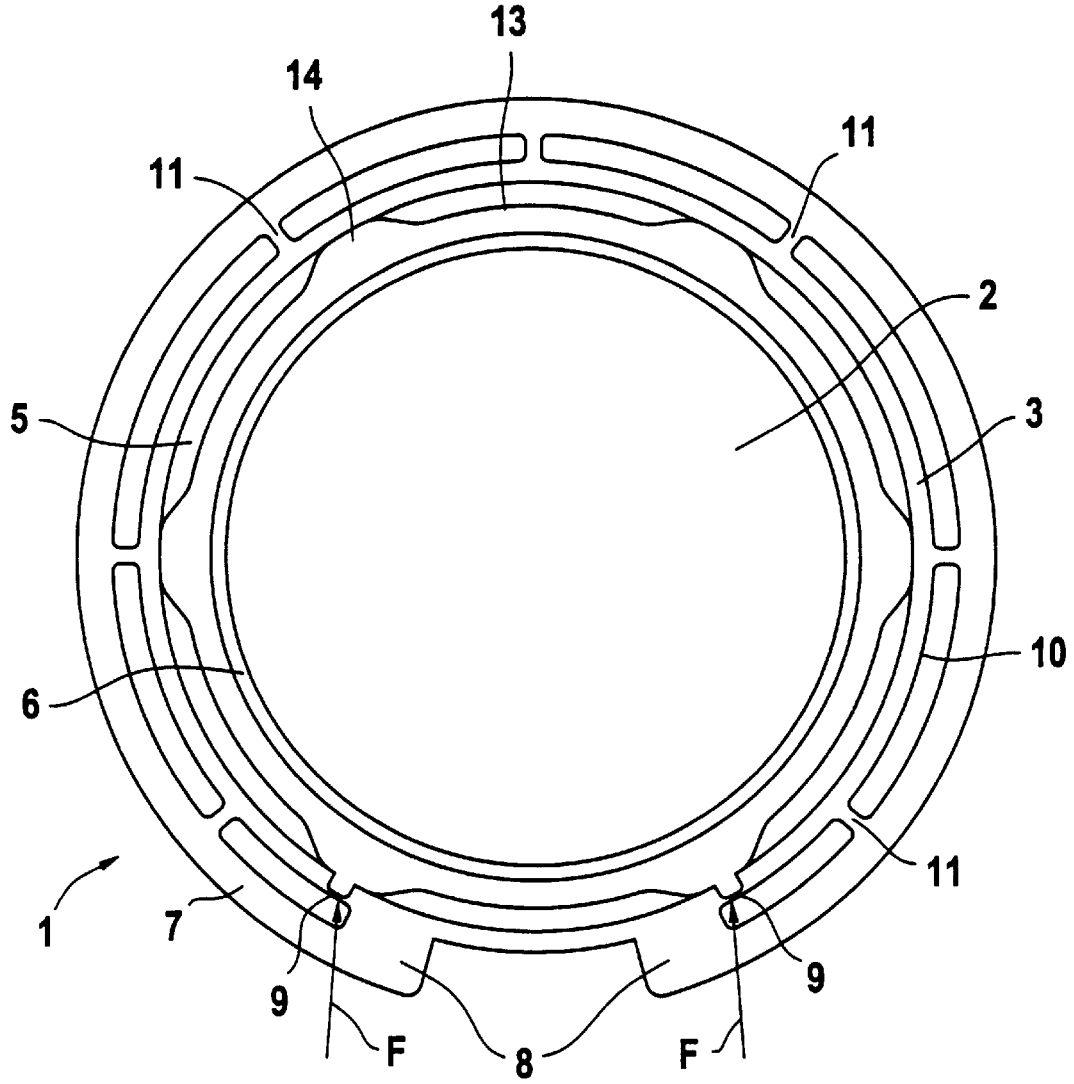

FIG. 3 shows a view of an embodiment of a closure cap 1 with which, additional to the firm connections at the connecting points 8, the pull-off ring 7 is connected to the wall at its edge area 10 by means of frangible bridges 11. A sealing element in the form of a sealing lip 6 running concentrically to the wall 3 is arranged on the closure base 2. The vertical frangible lines are formed as a thinning of the material on the inside of the wall 3. Both the arrows F signify where the force is imparted to the wall 3 if the closure cap 1 is opened by pulling on the pull-off ring 7.

Figure 4:
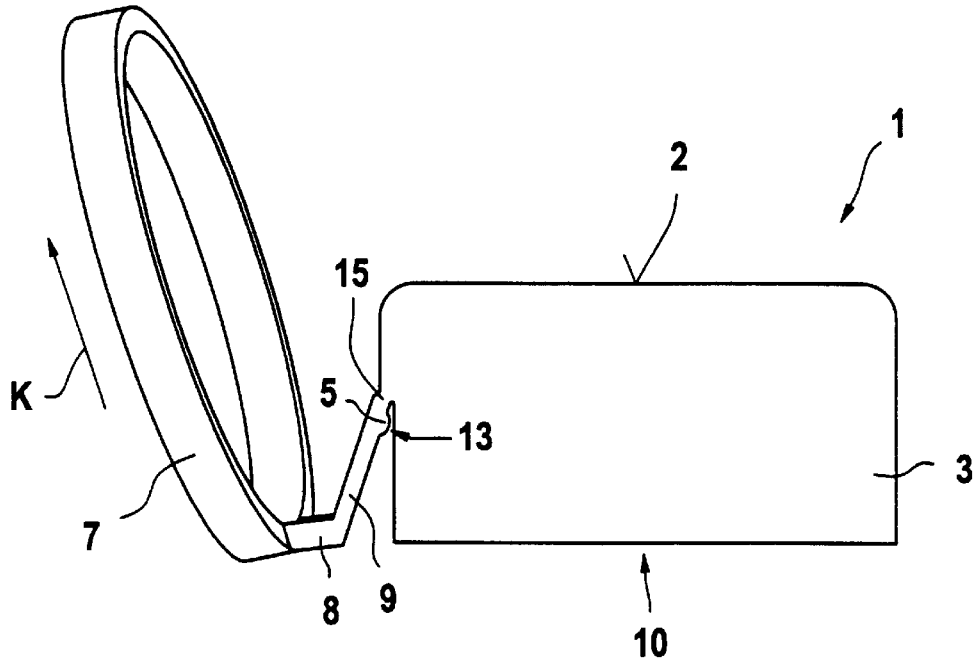

FIG. 4 shows how a closure cap 1 is opened by pulling the pull-off ring 7 in the direction K. With that, the pull-off ring 7 becomes gently bent in the area of the connecting points 8 and the portion of the wall 3 lying between two vertical frangible lines 9 is folded outwards. The hinge 15, provided between both the vertical frangible lines 9 and running horizontally on the wall, facilitates the bending over of the area torn out of the wall 3. The frangible lines 9 run towards the closure base sufficiently far that a section of the retaining bead 5 or at least of the retaining area 13 is contained in the area folded out of the wall 3.

Figure 5:
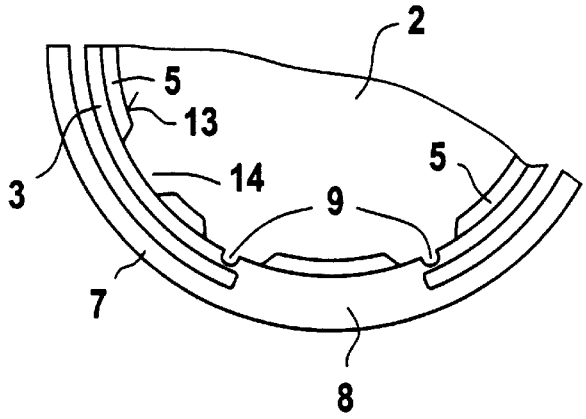

FIG. 5 shows a further embodiment of a closure cap with which the pull-off ring 3 forms a continuous ring. The ring is connected to the edge area 10 of the wall 3 at a single connecting point 8. Both the vertical frangible lines 9 are arranged to border on the connecting point 8 and formed as a thinning of the wall 3 on its inside. The retaining bead 5 is divided into a plurality of sections by interruptions 14.

Figure 6:
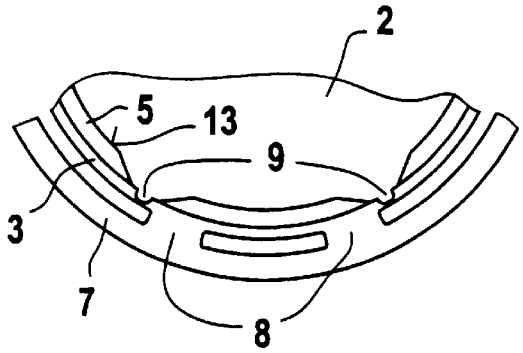

FIG. 6 shows a closure cap that differs from the embodiment shown in FIG. 5 in that the continuous pull-off ring 7 is connected by two connecting points 8 to the edge area 10 of the wall 3.

Figure 7:
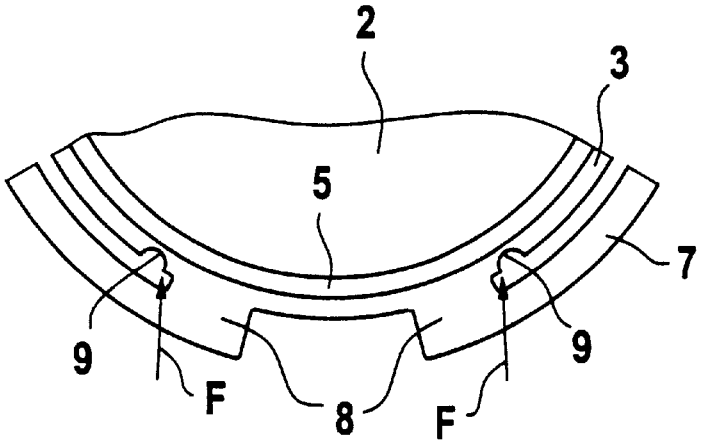

FIG. 7 shows an embodiment with which the vertical frangible lines 9 are formed as a thinning of the wall 3 on its outside, and with which the retaining bead 5 runs uniformly. The two arrows F indicate how the force, exerted from the pull-off ring 7 onto the wall 3 when tearing off the closure cap 1, acts upon the area of the frangible lines 9.

Figure 8:
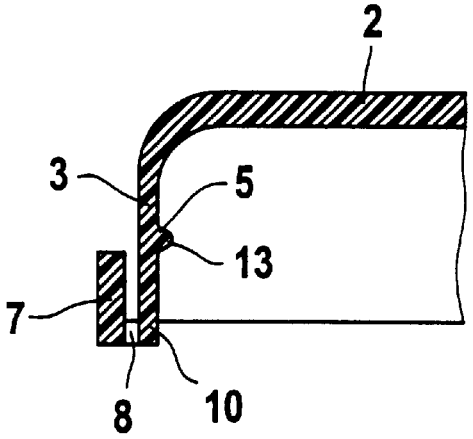
Figure 9:
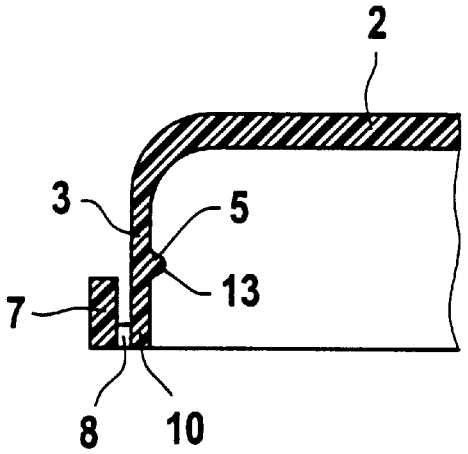

FIGS. 8 and 9 show possible designs for the connecting points 8. FIG. 8 shows connecting points 8 which extend from the edge area 10 of the wall 3 downwards. The pull-off ring 7 is as a result arranged somewhat below the wall 3. On the inside of the wall 3, the retaining area 13 of the retaining bead 5 is shown.

The pull-off ring 7 can, however, also be connected to the wall 3 with connecting points 8, said connecting points extending horizontally and radially outwards from the edge area 10 of the wall 3. In the embodiment according to FIG. 9, the lower edge of the pull-off ring 7 thus lies in the same plane as the edge area 10 of the wall 3. In FIGS. 8 and 9, it can also be seen that the axial stretching of the pull-off ring 7 must be kept small in relation to the axial stretching of the wall 3. The less the stretching of the pull-off ring 7, the better that the force applied to the pull-off ring 7 will be transferred to the vertical frangible lines.

We claim:

1. A plastic closure cap for a container having radially protruding retaining elements for the affixing of said closure cap, the closure cap comprising a closure base and a cylindrical wall abutting said closure base, and a pull-off ring, the wall having a edge area that is oriented away from the closure base, said wall being engageable with the container opening and having a substantially annular attachment area with at least one radially inwardly aligned retaining bead having a rataining area, the retaining area of said bead determining a free inside diameter of the closure cap, said cap further comprising at least two substantially vertical frangible lines being provided in the wall:

the pull-off ring extending at least partially and substantially concentrically around the wall and being connected with the wall at least one connecting point, the pull-off ring acting upon the edge area of the wall and the vertical frangible lines lying adjacent to the at least one connecting points, such that the vertical frangible lines extend from the edge area of the wall approximately vertically towards the cap base and terminate in an area between the retaining area and the closure base, the retaining bead having more than two interruptions, two of which are arranged such that they cross the frangible lines.

2. closure cap according to claim 1, characterized in that there are two connecting points.

3. A closure cap according to claim 1, characterized in that the pull-off ring is connected with the edge area of the wall by at least one frangible bridge.

4. A closure cap according to claim 1, characterized in that the pull-off ring is a continuous ring.

5. A closure cap according to claim 2, characterized in that the pull-off ring extends from one connecting point to the other connecting point in a sector of at least 270°.

6. A closure cap according to claim 1, characterized in that the vertical frangible lines are provided on an inner surface of the wall.

7. A closure cap according to claim 1, characterized in that the vertical frangible lines are provided on an outer surface of the wall.

8. A closure cap according to claim 1, characterized in that the vertical frangible lines are formed by weakening material of the wall.

9. A closure cap according to claim 1, characterized in that a horizontal hinge is provided in the wall, said hinge extending between ends of two frangible lines, said ends being oriented towards the closure base.

10. A closure cap according to claim 1, characterized in that at least one sealing lip running concentrically to the wall is provided on the closure base and/or the wall.

* * * * *